US005617674A

United States Patent [19]

Terrill

[11] Patent Number: 5,617,674

[45] Date of Patent: Apr. 8, 1997

[54] ADJUSTABLE PASSAGEWAY GATE

[76] Inventor: Timothy T. Terrill, 32 Fox Pl., Hicksville, N.Y. 11801

[21] Appl. No.: 642,200

[22] Filed: May 6, 1996

[51] Int. Cl.[6] ..... E06B 7/00

[52] U.S. Cl. ..... 49/55; 49/57; 49/465; 49/506

[58] Field of Search ..... 49/55, 57, 50, 49/465, 463, 506; 160/215, 216, 222

[56] References Cited

U.S. PATENT DOCUMENTS

| | | | |
|---|---|---|---|
| 3,000,063 | 9/1961 | Hoog | 49/55 X |
| 4,677,791 | 7/1987 | Larson et al. | 49/463 |
| 4,685,247 | 8/1987 | Alam | 49/55 |
| 4,761,319 | 8/1988 | Kraus et al. | 428/99 |
| 4,787,174 | 11/1988 | Brown | 49/55 |
| 5,207,022 | 5/1993 | Watt | 49/50 |

*Primary Examiner*—Philip C. Kannan
*Attorney, Agent, or Firm*—Richard L. Miller, P.E.

[57] ABSTRACT

An adjustable passageway gate that includes a thin generally rectangular-parallelepiped-shaped panel, a large, extendable, retractable, and generally rectangular-parallelepiped-shaped extension member, a pair of small, spaced-apart, extendable, retractable, and generally rectangular-parallelepiped-shaped extension members, an elongated and generally rectangular-parallelepiped-shaped cross member, and a bolt. The thin generally rectangular-parallelepiped-shaped panel is positionable in on one side of a wall. The large, extendable, retractable, and generally rectangular-parallelepiped-shaped extension member and the pair of small, spaced-apart, extendable, retractable, and generally rectangular-parallelepiped-shaped extension members are extendable to contact the wall when the passageway of the wall is wider than the thin generally rectangular-parallelepiped-shaped panel. The elongated and generally rectangular-parallelepiped-shaped cross member is displaced a distance from the thin generally rectangular-parallelepiped-shaped panel and contacts the other side of the wall. The bolt passes through a centrally-disposed and laterally-oriented throughbore of the elongated and generally rectangular-parallelepiped-shaped cross member and threadably engages the centrally-disposed and laterally-oriented threaded throughbore of the thin generally rectangular-parallelepiped-shaped panel, so that the wall is sandwiched therebetween and the passageway of the wall is blocked.

24 Claims, 2 Drawing Sheets

ADJUSTABLE PASSAGEWAY GATE

BACKGROUND OF THE INVENTION

The present invention relates to an adjustable passageway gate. More particularly, the present invention relates to an adjustable passageway gate that includes a thin generally rectangular-parallelepiped-shaped panel; a large, extendable, retractable, and generally rectangular-parallelepiped-shaped extension member that is extendable from and retractable into one side of the thin generally rectangular-parallelepiped-shaped panel; a pair of small, spaced-apart, extendable, retractable, and generally rectangular-parallelepiped-shaped extension members that are extendable from and retractable into the opposite side of the thin generally rectangular-parallelepiped-shaped panel; an elongated and generally rectangular-parallelepiped-shaped cross member displaced a distance from the thin generally rectangular-parallelpiped-shaped panel; and a bolt passing through the elongated and generally rectangular-parallelpiped-shaped cross member and threadably engaging the thin generally rectangular-parallelpiped-shaped panel.

Security gates provide an important function in the home where doors do not exist, or are open, to keep children from leaving a safe area, as well as to prevent them entering a dangerous area. These gates also find a useful application in preventing pets from leaving areas in the house designated for the pet and from entering areas where the pet should not go.

Among various types of security gates available, most have relatively movable parts which enable it to expand laterally and increase its effective width. Frictional bumpers are provided on opposite sides of the gate for fictionally engaging opposite sides of a door jamb, and expansion of the gate places it under compression within the door jamb. In this state, the bumpers fictionally engage the door jamb and firmly hold the gate in place under most circumstances.

Numerous innovations for security barriers have been provided in the prior art that will be described. However, even though these innovations may be suitable for the specific individual purposes to which they address, they differ from the present invention in that they do not teach an adjustable passageway gate that includes a thin generally rectangular-parallelpiped-shaped panel; a large, extendable, retractable, and generally rectangular-parallelpiped-shaped extension member that is extendable from and retractable into one side of the thin generally rectangular-parallelpiped-shaped panel; a pair of small, spaced-apart, extendable, retractable, and generally rectangular-parallelpiped-shaped extension members that are extendable from and retractable into the opposite side of the thin generally rectangular-parallelpiped-shaped panel; an elongated and generally rectangular-parallelpiped-shaped cross member displaced a distance from the thin generally rectangular-parallelpiped-shaped panel; and a bolt passing through the elongated and generally rectangular-parallelpiped-shaped cross member and threadably engaging the thin generally rectangular-parallelpiped-shaped panel.

FOR EXAMPLE, U.S. Pat. No. 4,677,791 to Larson et al. teaches an adjustable gate for doorways that includes a plurality of frictional bumpers, and a socket defining mounting member for each fictional bumper that is secured to the door jamb and is configured to receive and retain the frictional bumper.

ANOTHER EXAMPLE, U.S. Pat. No. 4,685,247 to Alam teaches a safety barrier that includes a substantially rectangular frame assembly, and independent adjustable clamping means disposed at each corner of the substantially rectangular frame assembly for securing the substantially rectangular frame assembly within the passageway.

STILL ANOTHER EXAMPLE, U.S. Pat. No. 4,761,319 to Kraus et al. teaches a closure cover that includes a cover plate having a plurality of resilient holding elements depending therefrom. The plurality of resilient holding elements include jaw portions extending laterally therefrom. The jaw portions of adjacent holding elements are located at different distances from the cover plate.

FINALLY, YET ANOTHER EXAMPLE, U.S. Pat. No. 5,207,022 to Watt teaches a security closure that includes a panel of sheet material having an inner face and an outer face and a plurality of throughbores, and at least two elongated pin members each of which having a blank head. Each of the at least two elongated pin members pass through a separate one of the plurality of throughbores with the head thereof in individual abutting alignment with the outer face of the panel.

It is apparent that numerous innovations for security barriers have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide an adjustable passageway gate that avoids the disadvantages of the prior art.

ANOTHER OBJECT of the present invention is to provide an adjustable passageway gate that is simple and inexpensive to manufacture.

STILL ANOTHER OBJECT of the present invention is to provide an adjustable passageway gate that is simple to use.

BRIEFLY STATED, YET ANOTHER OBJECT of the present invention is to provide an adjustable passageway gate that includes a thin generally rectangular-parallelpiped-shaped panel, a large, extendable, retractable, and generally rectangular-parallelpiped-shaped parallelepiped-shaped extension member, a pair of small, spaced-apart, extendable, retractable, and generally rectangular-parallelpiped-shaped parallelepiped-shaped extension members, an elongated and generally rectangular-parallelpiped-shaped cross member, and a bolt.

STILL YET ANOTHER OBJECT of the present invention is to provide an adjustable passageway gate wherein the thin generally rectangular-parallelpiped-shaped panel has a first side, a second side disposed opposite to the first side of the thin generally rectangular-parallelpiped-shaped panel, and a centrally-disposed and laterally-oriented threaded throughbore.

YET STILL ANOTHER OBJECT of the present invention is to provide an adjustable passageway gate wherein the thin generally rectangular-parallelpiped-shaped panel is positionable in a passageway defined by a wall that has a first side and a second side disposed opposite to the first side of the wall.

STILL YET ANOTHER OBJECT of the present invention is to provide an adjustable passageway gate wherein the large, extendable, retractable, and generally rectangular-parallelepiped-shaped extension member is extendable from and retractable into the first side of the thin generally rectangular-parallelpiped-shaped panel and is extended to contact the first side of the wall when the passageway of the wall is wider than the Chin generally rectangular-parallelpiped-shaped panel.

YET STILL ANOTHER OBJECT of the present invention is to provide an adjustable passageway gate wherein the pair of small, spaced-apart, extendable, retractable, and generally rectangular-parallelpiped-shaped extension members are extendable from and retractable into the second side of the thin generally rectangular-parallelpiped-shaped panel and are extended to contact the first side of the wall when the passageway of the wall is wider than the thin generally rectangular-parallelpiped-shaped panel.

STILL YET ANOTHER OBJECT of the present invention is to provide an adjustable passageway gate wherein the pair of small, spaced-apart, extendable, retractable, and generally rectangular-parallelepiped-shaped extension members are spaced apart, so that the adjustable passageway gate can straddle a lower door hinge of a door when the passageway is created by the door being opened and can be used on doors that swing outwardly and inwardly to the right and to the left.

YET STILL ANOTHER OBJECT of the present invention is to provide an adjustable passageway gate wherein the elongated and generally rectangular-parallelpiped-shaped cross member is displaced a distance from the thin generally rectangular-parallelpiped-shaped panel and has a centrally-disposed and laterally-oriented throughbore and contacts the second side of the wall.

STILL YET ANOTHER OBJECT of the present invention is to provide an adjustable passageway gate wherein the bolt passes through the centrally-disposed and laterally-oriented throughbore of the elongated and generally rectangular-parallelpiped-shaped cross member and threadably engages the centrally-disposed and laterally-oriented threaded throughbore of the thin generally rectangular-parallelpiped-shaped panel, so that the wall is sandwiched between the thin generally rectangular-parallelpiped-shaped panel and the elongated and generally rectangular-parallelpiped-shaped cross member and the passageway of the wall is blocked.

YET STILL ANOTHER OBJECT of the present invention is to provide an adjustable passageway gate wherein the thin generally rectangular-parallelpiped-shaped panel further has a generally rectangular-parallelpiped-shaped front face with a top, a bottom, a first side, a second side disposed opposite to the first side of the thin generally rectangular-parallelpiped-shaped panel, and a centrally-disposed, laterally-oriented, and threaded throughbore.

STILL YET ANOTHER OBJECT of the present invention is to provide an adjustable passageway gate wherein the thin generally rectangular-parallelpiped-shaped panel further has a generally rectangular-parallelpiped-shaped second face that is displaced a distance from and is parallel to the generally rectangular-parallelpiped-shaped first face of the thin generally rectangular-parallelpiped-shaped panel and has a top, a bottom, a first side, and a second side disposed opposite to the first side of the thin generally rectangular-parallelpiped-shaped panel.

YET STILL ANOTHER OBJECT of the present invention is to provide an adjustable passageway gate wherein the generally rectangular-parallelpiped-shaped second face of the thin generally rectangular-parallelpiped-shaped panel has a centrally-disposed, laterally-oriented, and threaded throughbore that is in lateral alignment with the centrally-disposed, laterally-oriented, and threaded throughbore of the generally rectangular-parallelpiped-shaped first face of the thin generally rectangular-parallelpiped-shaped panel.

STILL YET ANOTHER OBJECT of the present invention is to provide an adjustable passageway gate wherein the thin generally rectangular-parallelpiped-shaped panel further has an upper internally-disposed and substantially T-shaped member that connects the top of the generally rectangular-parallelpiped-shaped first face of the thin generally rectangular-parallelpiped-shaped panel to the top of the generally rectangular-parallelpiped-shaped second face of the thin generally rectangular-parallelpiped-shaped panel, YET STILL ANOTHER OBJECT of the present invention is to provide an adjustable passageway gate wherein the upper internally-disposed and substantially T-shaped member of the thin generally rectangular-parallelpiped-shaped panel has a horizontal part that has a midpoint and a pair of ends and extends along the top of the generally rectangular-parallelpiped-shaped first face of the thin generally rectangular-parallelpiped-shaped panel and along the top of the generally rectangular-parallelpiped-shaped second face of the thin generally rectangular-parallelpiped-shaped panel and forms therewith a top of the thin generally rectangular-parallelpiped-shaped panel, STILL YET ANOTHER OBJECT of the present invention is to provide an adjustable passageway gate wherein the upper internally-disposed and substantially T-shaped member of the thin generally rectangular-parallelpiped-shaped panel further has a downwardly-extending vertical part that has a length and extends downwardly from the midpoint of the horizontal part of the upper internally-disposed and substantially T-shaped member of the thin generally rectangular-parallelpiped-shaped panel and terminates prior to the centrally-disposed, laterally-oriented, and threaded throughbore of the thin generally rectangular-parallelpiped-shaped panel.

YET STILL ANOTHER OBJECT of the present invention is to provide an adjustable passageway gate wherein the upper internally-disposed and substantially T-shaped member of the thin generally rectangular-parallelpiped-shaped panel further has a pair of downwardly-extending vertical end parts that extend downwardly from the pair of ends of the horizontal part of the upper internally-disposed and substantially T-shaped member of the thin generally rectangular-parallelpiped-shaped panel a distance less than the length of the vertical part of the upper internally-disposed and substantially T-shaped member of the thin generally rectangular-parallelpiped-shaped panel.

STILL YET ANOTHER OBJECT of the present invention is to provide an adjustable passageway gate wherein the thin generally rectangular-parallelpiped-shaped panel further has a lower internally-disposed and inverted substantially T-shaped member that connects the bottom of the generally rectangular-parallelpiped-shaped first face of the thin generally rectangular-parallelpiped-shaped panel to the bottom of the generally rectangular-parallelpiped-shaped second face of the thin generally rectangular-parallelpiped-shaped panel.

YET STILL ANOTHER OBJECT of the present invention is to provide an adjustable passageway gate wherein the lower internally-disposed and inverted substantially T-shaped member of the thin generally rectangular-parallelpiped-shaped panel has a horizontal part that has a midpoint and a pair of ends and extends along the bottom of the generally rectangular-parallelpiped-shaped first face of the thin generally rectangular-parallelpiped-shaped panel and the bottom of the generally rectangular-parallelpiped-shaped second face of the thin generally rectangular-parallelpiped-shaped panel and forms therewith a bottom of the thin generally rectangular-parallelpiped-shaped panel.

STILL YET ANOTHER OBJECT of the present invention is to provide an adjustable passageway gate wherein the lower internally-disposed and inverted substantially T-shaped member of the thin generally rectangular-parallelpiped-shaped panel further has an upwardly-extending vertical part that has a length and extends upwardly from the midpoint of the horizontal part of the lower internally-disposed and inverted substantially T-shaped member of the thin generally rectangular-parallelpiped-shaped panel and terminates prior to the centrally-disposed, laterally-oriented, and threaded throughbore of the thin generally rectangular-parallelpiped-shaped panel.

YET STILL ANOTHER OBJECT of the present invention is to provide an adjustable passageway gate wherein the upwardly-extending vertical part of the lower internally-disposed and inverted substantially T-shaped member of the thin generally rectangular-parallelpiped-shaped panel is disposed below and in alignment with the downwardly-extending vertical part of the upper internally-disposed and substantially T-shaped member of the thin generally rectangular-parallelpiped-shaped panel.

STILL YET ANOTHER OBJECT of the present invention is to provide an adjustable passageway gate wherein the lower internally-disposed and inverted substantially T-shaped member of the thin generally rectangular-parallelpiped-shaped panel further has a pair of upwardly-extending vertical end parts that extend upwardly from the pair of ends of the horizontal part of the lower internally-disposed and inverted substantially T-shaped member of the thin generally rectangular-parallelpiped-shaped panel a distance less than the length of the upwardly-extending vertical part of the lower internally-disposed and inverted substantially T-shaped member of the thin generally rectangular-parallelpiped-shaped panel.

YET STILL ANOTHER OBJECT of the present invention is to provide an adjustable passageway gate wherein one of the pair of upwardly-extending vertical end parts of the pair of ends of the lower internally-disposed and inverted substantially T-shaped member of the thin generally rectangular-parallelpiped-shaped panel is displaced below and in alignment with a corresponding one of the pair of downwardly-extending vertical end parts of the pair of ends of the upper internally-disposed and substantially T-shaped member of the thin generally rectangular-parallelpiped-shaped panel and forms therewith a first side of the thin generally rectangular-parallelpiped-shaped panel and defines therebetween a long throughslot of the first side of the thin generally rectangular-parallelpiped-shaped panel.

STILL YET ANOTHER OBJECT of the present invention is to provide an adjustable passageway gate wherein the first side of the thin generally rectangular-parallelpiped-shaped panel, the downwardly-extending vertical part of the upper internally-disposed and substantially T-shaped member of the thin generally rectangular-parallelpiped-shaped panel, a part of the horizontal part of the upper internally-disposed and substantially T-shaped member of the thin generally rectangular-parallelpiped-shaped panel between the first side of the thin generally rectangular-parallelepiped-shaped panel and the downwardly-extending vertical part of the upper internally-disposed and substantially T-shaped member of the thin generally rectangular-parallelpiped-shaped panel, the upwardly extending vertical part of the lower internally-disposed and inverted substantially T-shaped member of the thin generally rectangular-parallelepiped-shaped panel, and a part of the horizontal part of the lower internally-disposed and inverted substantially T-shaped member of the thin generally rectangular-parallelpiped-shaped panel between the first side of the thin generally rectangular-parallelpiped-shaped panel and the upwardly-extending vertical part of the upper internally-disposed and inverted substantially T-shaped member of the thin generally rectangular-parallelpiped-shaped panel together define a large, internally-disposed, and generally rectangular-parallelpiped-shaped chamber that opens into the long throughslot of the first side of the thin generally rectangular-parallelpiped-shaped panel.

YET STILL ANOTHER OBJECT of the present invention is to provide an adjustable passageway gate wherein the thin generally rectangular-parallelpiped-shaped panel further has a pair of shoulders formed where the long throughslot of the first side of the thin generally rectangular-parallelpiped-shaped panel opens into the large, internally-disposed, and generally rectangular-parallelpiped-shaped chamber of the thin generally rectangular-parallelpiped-shaped panel.

STILL YET ANOTHER OBJECT of the present invention is to provide an adjustable passageway gate wherein the thin generally rectangular-parallelpiped-shaped panel further has a second side internally-disposed and substantially T-shaped member that is disposed on the second side of the thin generally rectangular-parallelpiped-shaped panel opposite to the long throughslot of the first side of the thin generally rectangular-parallelpiped-shaped panel.

YET STILL ANOTHER OBJECT of the present invention is to provide an adjustable passageway gate wherein the second side internally-disposed and substantially T-shaped member of the thin generally rectangular-parallelepiped-shaped panel has a vertical part that has a midpoint and extends along the second side of the first face of the thin generally rectangular-parallelpiped-shaped panel and along the second side of the generally rectangular-parallelpiped-shaped second face of the thin generally rectangular-parallelpiped-shaped panel.

STILL YET ANOTHER OBJECT of the present invention is to provide an adjustable passageway gate wherein the second side internally-disposed and substantially T-shaped member of the thin generally rectangular-parallelpiped-shaped panel further has an inwardly-extending horizontal part that extends inwardly from the midpoint of the second side T-shaped member vertical part of the second side internally-disposed and substantially T-shaped member of the thin generally rectangular-parallelpiped-shaped panel and terminates prior to the centrally-disposed, laterally-oriented, and threaded throughbore of the thin generally rectangular-parallelpiped-shaped panel.

YET STILL ANOTHER OBJECT of the present invention is to provide an adjustable passageway gate wherein the vertical part of the second side internally-disposed and substantially T-shaped member of the thin generally rectangular-parallelpiped-shaped panel is spaced between another one of the pair of downwardly-extending vertical end parts of the upper internally-disposed and inverted substantially T-shaped member of the thin generally rectangular-parallelpiped-shaped panel and a corresponding one of the pair of upwardly-extending vertical end parts of the lower internally-disposed and inverted substantially T-shaped member of the thin generally rectangular-parallelpiped-shaped panel and defines therebetween a pair of short throughslots and forms therewith a second side of the thin generally rectangular-parallelpiped-shaped panel.

STILL YET ANOTHER OBJECT of the present invention is to provide an adjustable passageway gate wherein each of the pair of short throughslots of the second side of the thin generally rectangular-parallelpiped-shaped panel is shorter than the long throughslot of the first side of the thin generally rectangular-parallelpiped-shaped panel.

YET STILL ANOTHER OBJECT of the present invention is to provide an adjustable passageway gate wherein the second side of the thin generally rectangular-parallelepiped-shaped panel, the downwardly-extending vertical part of the internally-disposed and substantially T-shaped member of the thin generally rectangular-parallelpiped-shaped panel, a part of the horizontal part of the upper internally-disposed and substantially T-shaped member of the thin generally rectangular-parallelpiped-shaped panel between the second side of the thin generally rectangular-parallelpiped-shaped panel and the downwardly-extending vertical part of the internally-disposed and substantially T-shaped member of the thin generally rectangular-parallelpiped-shaped panel, the upwardly-extending vertical part of the lower internally-disposed and inverted substantially T-shaped member of the thin generally rectangular-parallelpiped-shaped panel, a part of the horizontal part of the lower internally-disposed and inverted substantially T-shaped member of the thin generally rectangular-parallelpiped-shaped panel between the second side of the thin generally rectangular-parallelpiped-shaped panel and the upwardly-extending vertical part of the internally-disposed and inverted substantially T-shaped member of the thin generally rectangular-parallelpiped-shaped panel, and the second side internally-disposed and substantially T-shaped member together define a pair of small, internally-disposed, spaced-apart, and generally rectangular-parallelpiped-shaped chambers that open into the pair of short throughslots of the second side of the thin generally rectangular-parallelpiped-shaped panel.

STILL YET ANOTHER OBJECT of the present invention is to provide an adjustable passageway gate wherein each of the pair of small, internally-disposed, spaced-apart, and generally rectangular-parallelpiped-shaped chambers of the thin generally rectangular-parallelpiped-shaped panel is smaller than the large, internally-disposed, and generally rectangular-parallelpiped-shaped chamber of the thin generally rectangular-parallelpiped-shaped panel.

YET STILL ANOTHER OBJECT of the present invention is to provide an adjustable passageway gate wherein the thin generally rectangular-parallelpiped-shaped panel further has two pair of side shoulders formed where the pair of short throughslots of the second side of the thin generally rectangular-parallelpiped-shaped panel open into the pair of small, internally-disposed, spaced-apart, and generally rectangular-parallelpiped-shaped chambers of the thin generally rectangular-parallelpiped-shaped panel.

STILL YET ANOTHER OBJECT of the present invention is to provide an adjustable passageway gate wherein the large, extendable, retractable, and generally rectangular-parallelpiped-shaped extension member has a distal side and a proximal side from which a pair of outwardly-extending stop blocks outwardly extend.

YET STILL ANOTHER OBJECT of the present invention is to provide an adjustable passageway gate wherein the large, extendable, retractable, and generally rectangular-parallelpiped-shaped extension member of the thin generally rectangular-parallelpiped-shaped panel is movably disposed in the large, internally-disposed, and generally rectangular-parallelpiped-shaped chamber of the thin generally rectangular-parallelpiped-shaped panel and is slidable through the long throughslot of the first side of the thin generally rectangular-parallelpiped-shaped panel.

STILL YET ANOTHER OBJECT of the present invention is to provide an adjustable passageway gate the large, extendable, retractable, and generally rectangular-parallelpiped-shaped extension member of the thin generally rectangular-parallelpiped-shaped panel is slidably extendable from the large, internally-disposed, and generally rectangular-parallelpiped-shaped chamber of the thin generally rectangular-parallelpiped-shaped panel until the pair of outwardly-extending stop blocks of the proximal side of the large, extendable, retractable, and generally rectangular-parallelpiped-shaped extension member contact the pair of shoulders of the first side of the thin generally rectangular-parallelpiped-shaped panel.

YET STILL ANOTHER OBJECT of the present invention is to provide an adjustable passageway gate wherein the large, extendable, retractable, and generally rectangular-parallelpiped-shaped extension member of the thin generally rectangular-parallelpiped-shaped panel is slidably retractable into the large, internally-disposed, and generally rectangular-parallelepiped-shaped chamber of the thin generally rectangular-parallelpiped-shaped panel until the proximal side of the large, extendable, retractable, and generally rectangular-parallelpiped-shaped extension member contacts the upwardly-extending vertical part of the lower internally-disposed and inverted substantially T-shaped member of the thin generally rectangular-parallelpiped-shaped panel and the downwardly-extending vertical part of the upper internally-disposed and substantially T-shaped member of the thin generally rectangular-parallelpiped-shaped panel.

STILL YET ANOTHER OBJECT of the present invention is to provide an adjustable passageway gate wherein each of the pair of small, spaced-apart, extendable, retractable, and generally rectangular-parallelpiped-shaped extension members has a distal side and a proximal side from which a pair of outwardly-extending stop blocks outwardly extend.

YET STILL ANOTHER OBJECT of the present invention is to provide an adjustable passageway gate wherein each of the pair of small, spaced-apart, extendable, retractable, and generally rectangular-parallelpiped-shaped extension members of the thin generally rectangular-parallelpiped-shaped panel is movably disposed in a respective one of the pair of small, internally-disposed, spaced-apart, and generally rectangular-parallelpiped-shaped chambers of the thin generally rectangular-parallelpiped-shaped panel and is slidable through a respective one of the pair of short throughslots of the second side of the thin generally rectangular-parallelpiped-shaped panel.

STILL YET ANOTHER OBJECT of the present invention is to provide an adjustable passageway gate wherein each of-the pair of small, spaced-apart, extendable, retractable, and generally rectangular-parallelpiped-shaped extension members of the thin generally rectangular-parallelpiped-shaped panel is slidably extendable from the respective one of the pair of small, internally-disposed, spaced-apart, and generally rectangular-parallelpiped-shaped chambers of the thin generally rectangular-parallelpiped-shaped panel until the pair of outwardly-extending stop blocks of the proximal side of the respective one of the pair of small, spaced-apart, extendable, retractable, and generally rectangular-parallelpiped-shaped extension members of the thin generally rectangular-parallelpiped-shaped panel contact a respective pair of the two pair of shoulders of the second side of the thin generally rectangular-parallelpiped-shaped panel.

YET STILL ANOTHER OBJECT of the present invention is to provide an adjustable passageway gate wherein each of the pair of small, spaced-apart, extendable, retractable, and generally rectangular-parallelpiped-shaped extension members of the thin generally rectangular-parallelpiped-shaped panel is slidably retractable into the respective one of the pair of small, internally-disposed, spaced-apart, and generally rectangular-parallelpiped-shaped chambers of-the thin generally rectangular-parallelpiped-shaped panel until the proximal side of the respective one of the pair of small, spaced-apart, extendable, retractable, and generally rectangular-parallelpiped-shaped extension members of the thin generally rectangular-parallelpiped-shaped panel contacts a respective one of the upwardly-extending vertical part of the lower internally-disposed and inverted substantially T-shaped member of the thin generally rectangular-parallelpiped-shaped panel and the downwardly-extending vertical part of the upper internally-disposed and substantially T-shaped member of the thin generally rectangular-parallelpiped-shaped panel.

STILL YET ANOTHER OBJECT of the present invention is to provide an adjustable passageway gate wherein the bolt has a knob head and an outwardly extending and threaded shaft that extends outwardly from the knob head of the bolt and passes through the centrally-disposed, unthreaded, and laterally-oriented throughbore of the elongated and generally rectangular-parallelpiped-shaped cross member and threadably engages the centrally-disposed, laterally-oriented, and threaded throughbore of the thin generally rectangular-parallelpiped-shaped panel.

YET STILL ANOTHER OBJECT of the present invention is to provide an adjustable passageway gate wherein the knob head of the bolt has a shape and a size sufficient to make it difficult for a child to grab with the child's small hands of the child and has a diameter sufficient to prevent passage through the centrally-disposed, unthreaded, and laterally-oriented throughbore of the elongated and generally rectangular-parallelpiped-shaped cross member.

STILL YET ANOTHER OBJECT of the present invention is to provide a method of using an adjustable passageway gate to prevent the undesirable passage through a passageway defined by a structure that has a first side and a second side that is disposed opposite to the first side of the structure that comprises the steps of positioning a thin generally rectangular-parallelpiped-shaped panel of the adjustable passageway gate across the passageway and contacting the first side of the structure, positioning an elongated and generally rectangular-parallelpiped-shaped cross member of the adjustable passageway gate across the passageway and contacting the second side of the structure, turning a bolt of the adjustable passageway gate by a knob head of the bolt, causing an outwardly extending and threaded shaft of the bolt to pass through a centrally-disposed, laterally-oriented throughbore of the elongated and generally rectangular-parallelpiped-shaped cross member and be threaded into a centrally-disposed, laterally-oriented, and threaded throughbore of the thin generally rectangular-parallelpiped-shaped panel, and causing the elongated and generally rectangular-parallelpiped-shaped cross member and the thin generally rectangular-parallelpiped-shaped panel to move towards each other until the thin generally rectangular-parallelpiped-shaped panel securely abuts against the first side of the structure and the elongated and generally rectangular-parallelepiped-shaped cross member securely abuts against the second side of the structure, so that the structure is sandwiched therebetween and the passageway is blocked from undesirable passage therethrough.

FINALLY, YET STILL ANOTHER OBJECT of the present invention is to provide a method of using an adjustable passageway gate that further includes the step of extending a large, extendable, retractable, and generally rectangular-parallelpiped-shaped extension member of the adjustable passageway gate and a pair of small, spaced-apart, extendable, retractable, and generally rectangular-parallelpiped-shaped extension members of the adjustable passageway gate from the thin generally rectangular-parallelpiped-shaped panel a distance sufficient to contact the first side of the structure when the thin generally rectangular-parallelpiped-shaped panel is not wide enough to contact the first side of the structure itself with the pair of small, spaced-apart, extendable, retractable, and generally rectangular-parallelepiped-shaped extension members straddling a lower door hinge when the passageway is created by an open door.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
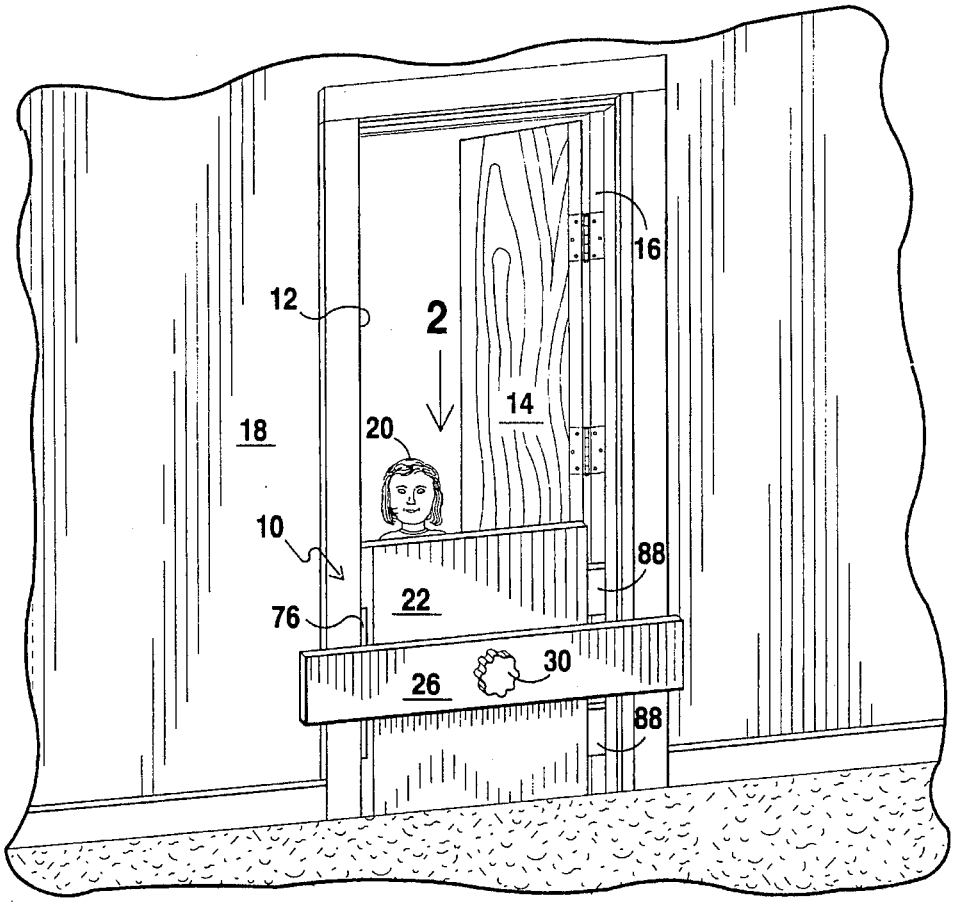
FIG. 1 is a diagrammatic perspective view illustrating the present invention being utilized to block the passageway of an opened door.

10 adjustable passageway gate of the present invention
12 opened door passageway
14 conventional door
16 conventional door
18 conventional wall
22 thin generally rectangular-parallelpiped-shaped panel
24 conventional wall first side
26 elongated and generally rectangular-parallelpiped-shaped cross member
28 conventional wall second side
30 bolt
32 panel generally rectangular-parallelpiped-shaped first face
34 panel front face centrally-disposed, laterally-oriented, and threaded throughbore
36 panel generally rectangular-parallelpiped-shaped second face
38 panel second face centrally-disposed, laterally-oriented, and threaded throughbore 40 panel upper internally-disposed and substantially T-shaped member
42 panel upper T-shaped member horizontal part
43 panel top
44 panel upper T-shaped member downwardly-extending vertical part
46 pair of panel upper T-shaped member downwardly-extending vertical end parts
47 pair of panel upper T-shaped member horizontal part ends
The thin generally rectangular-parallelpiped-shaped panel
48 panel lower internally-disposed and inverted substantially T-shaped member
50 panel lower T-shaped member horizontal part
51 panel bottom
52 panel lower T-shaped member upwardly-extending vertical part
54 pair of panel lower T-shaped member upwardly-extending vertical end parts
55 pair of panel lower T-shaped member horizontal part ends
56 panel first side 56
57 panel first side long throughslot
58 panel first side large, internally-disposed, and generally rectangular-parallelpiped-shaped chamber
60 pair of panel first side shoulders
62 panel second side internally-disposed and substantially T-shaped member
64 panel second side T-shaped member vertical part
66 panel second side T-shaped member inwardly-extending horizontal part
68 pair of panel second side short throughslots
70 panel second side
72 pair of panel second side small, internally-disposed, spaced-apart, and generally rectangular-parallelpiped-shaped chambers
74 two pair of panel second side shoulders
76 panel first side large, extendable, retractable, and generally rectangular-parallelpiped-shaped extension member
78 panel first side extension member distal side
80 panel first side extension member proximal side
82 pair of panel first side extension member proximal side outwardly-extending stop blocks
84 panel first side extension member extension arrow
86 panel first side extension member retraction arrow
88 pair of panel second side small, spaced-apart, extendable, retractable, and generally rectangular-parallelpiped-shaped extension members
90 panel second side extension member distal side
92 panel second side extension member proximal side
94 pair of panel second side extension member proximal side outwardly-extending stop blocks
96 panel second side extension member extension arrow
98 panel second side extension member retraction arrow
100 cross member centrally-disposed, unthreaded, and laterally-oriented clearance throughbore
102 bolt substantially star-shaped knob head
104 bolt outwardly extending and threaded shaft

DETAILED DESCRIPTION OF THE PREFERRED EMBODIMENT

Referring now to the figures in which like numerals indicate like parts, and particularly FIG. 1, the adjustable passageway gate of the present invention is shown generally at 10 blocking an opened door passageway 12 created by a conventional door 14 being pivoted open from a conventional door 16 fame that is secured to a conventional wall 18 and thereby preventing the unwanted passage of a child 20 therethrough.

Figure 2:
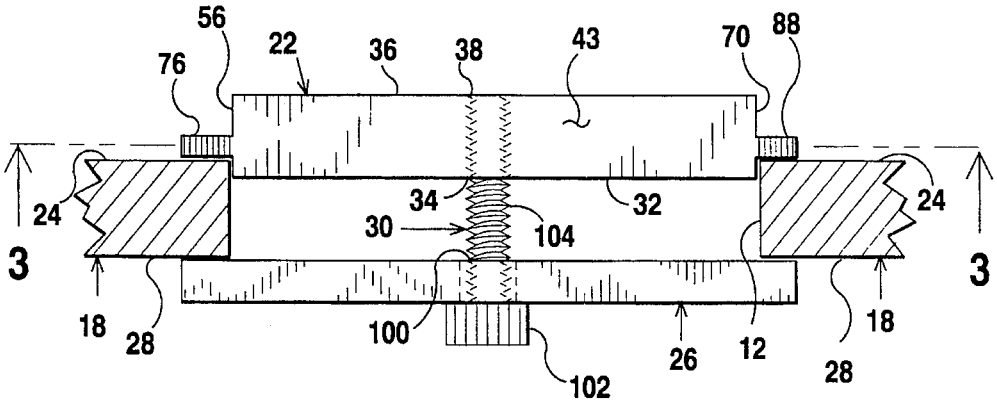
FIG. 2 is a diagrammatic top plan view taken in the direction of arrow 2 in FIG. 1.

The general configuration of the adjustable passageway gate 10 can best be seen in FIG. 2, and as such, will be discussed with reference thereto.

The adjustable passageway gate 10 includes a thin generally rectangular-parallelpiped-shaped panel 22 that is positionable along a conventional wall first side 24 of the conventional wall 18.

The adjustable passageway gate 10 further includes an elongated and generally rectangular-parallelpiped-shaped cross member 26 that is positionable along a conventional wall second side 28 of the conventional wall 18 which in opposite to the conventional wall first side 24 of the conventional wall 18.

The adjustable passageway gate 10 further includes a bolt 30 that secures the elongated and generally rectangular-parallelpiped-shaped cross member 26 to the thin generally rectangular-parallelpiped-shaped panel 22 with the conventional wall 18 disposed therebetween.

Figure 3:
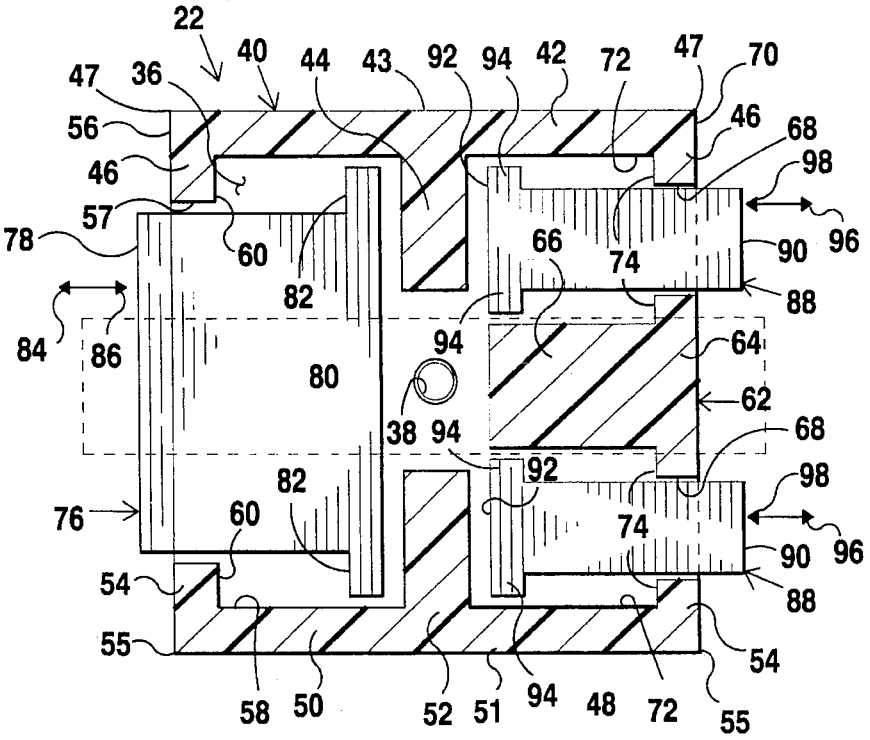
FIG. 3 is a cross sectional view taken on line 3—3 in FIG. 2.

The specific configuration of the thin generally rectangular-parallelpiped-shaped panel 22 can best be seen in FIGS. 2 and 3, and as such, will be discussed with reference thereto.

The thin generally rectangular-parallelpiped-shaped panel 22 has a panel generally rectangular-parallelpiped-shaped first face 32 with a panel front face centrally-disposed, laterally-oriented, and threaded throughbore 34.

The thin generally rectangular-parallelpiped-shaped panel 22 further has a panel generally rectangular-parallelpiped-shaped second face 36 that is displaced a distance from, and is parallel, to the panel generally rectangular-parallelpiped-shaped first face 32 of the thin generally rectangular-parallelpiped-shaped panel 22.

The panel generally rectangular-parallelpiped-shaped second face 36 of the thin generally rectangular-parallelpiped-shaped panel 22 has a panel second face centrally-disposed, laterally-oriented, and threaded throughbore 38 that is in lateral alignment with the panel first face centrally-disposed, laterally-oriented, and threaded throughbore 34 of the panel generally rectangular-parallelpiped-shaped first face 32 of the thin generally rectangular-parallelpiped-shaped panel 22.

The thin generally rectangular-parallelpiped-shaped panel 22 further has a panel upper internally-disposed and substantially T-shaped member 40 that connects the top of the panel generally rectangular-parallelpiped-shaped first face 32 of the thin generally rectangular-parallelpiped-shaped panel 22 to the top of the panel generally rectangular-parallelpiped-shaped second face 36 of the thin generally rectangular-parallelpiped-shaped panel 22.

The panel upper internally-disposed and substantially T-shaped member 40 of the thin generally rectangular-parallelpiped-shaped panel 22 has a panel upper T-shaped member horizontal part 42 that extends along the top of the panel generally rectangular-parallelpiped-shaped first face 32 of the thin generally rectangular-parallelpiped-shaped panel 22 and along the top of the panel generally rectangular-parallelpiped-shaped second face 36 of the thin generally rectangular-parallelpiped-shaped panel 22 and forms therewith a panel top 43.

The panel upper internally-disposed and substantially T-shaped member 40 of the thin generally rectangular-parallelpiped-shaped panel 22 further has a panel upper T-shaped member downwardly-extending vertical part 44 that extends downwardly from the midpoint of the panel upper T-shaped member horizontal part 42 of the panel upper internally-disposed and substantially T-shaped member 40 of the thin generally rectangular-parallelpiped-shaped panel 22 and terminates prior to the panel first face centrally-disposed, laterally-oriented, and threaded throughbore 34 of the panel generally rectangular-parallelpiped-shaped first face 32 of the thin generally rectangular-parallelpiped-shaped panel 22 and the aligned panel second face centrally-disposed, laterally-oriented, and threaded throughbore 38 of the panel generally rectangular-parallelpiped-shaped second face 36 of the thin generally rectangular-parallelpiped-shaped panel 22.

The panel upper internally-disposed and substantially T-shaped member 40 of the thin generally rectangular-parallelpiped-shaped panel 22 further has a pair of panel upper T-shaped member downwardly-extending vertical end parts 46 that extend downwardly from a pair of panel upper T-shaped member horizontal part ends 47 of the panel upper T-shaped member horizontal part 42 of the panel upper internally-disposed and substantially T-shaped member 40 of the thin generally rectangular-parallelpiped-shaped panel 22 a distance less than the length of the panel upper T-shaped member downwardly-extending vertical part 44 of the panel upper internally-disposed and substantially T-shaped member 40 of the thin generally rectangular-parallelpiped-shaped panel 22.

The thin generally rectangular-parallelpiped-shaped panel 22 further has a panel lower internally-disposed and inverted substantially T-shaped member 48 that connects the bottom of the panel generally rectangular-parallelpiped-shaped first face 32 of the thin generally rectangular-parallelpiped-shaped panel 22 to the bottom of the panel generally rectangular-parallelpiped-shaped second face 36 of the thin generally rectangular-parallelpiped-shaped panel 22.

The panel lower internally-disposed and inverted substantially T-shaped member 48 of the thin generally rectangular-parallelpiped-shaped panel 22 has a panel lower T-shaped member horizontal part 50 that extends along the bottom of the panel generally rectangular-parallelpiped-shaped first face 32 of the thin generally rectangular-parallelpiped-shaped panel 22 and the bottom of the panel generally rectangular-parallelpiped-shaped second face 36 of the thin generally rectangular-parallelpiped-shaped panel 22 and forms therewith a panel bottom 51.

The panel lower internally-disposed and inverted substantially T-shaped member 48 of the thin generally rectangular-parallelpiped-shaped panel 22 further has a panel lower T-shaped member upwardly-extending vertical part 52 that extends upwardly from the midpoint of the panel lower T-shaped member horizontal part 50 of the panel lower internally-disposed and inverted substantially T-shaped member 48 of the thin generally rectangular-parallelpiped-shaped panel 22 and terminates prior to the panel first face centrally-disposed, laterally-oriented, and threaded throughbore 34 of the panel generally rectangular-parallelpiped-shaped first face 32 of the thin generally rectangular-parallelpiped-shaped panel 22 and the aligned panel second face centrally-disposed, laterally-oriented, and threaded throughbore 38 of the panel generally rectangular-parallelpiped-shaped second face 36 of the thin generally rectangular-parallelpiped-shaped panel 22.

The panel lower T-shaped member upwardly-extending vertical part 52 of the panel lower internally-disposed and inverted substantially T-shaped member 48 of the thin generally rectangular-parallelpiped-shaped panel 22 is below, and in alignment with, the panel upper T-shaped member downwardly-extending vertical part 44 of the panel upper internally-disposed and substantially T-shaped member 40 of the thin generally rectangular-parallelpiped-shaped panel 22.

The panel lower internally-disposed and inverted substantially T-shaped member 48 of the thin generally rectangular-parallelpiped-shaped panel 22 further has a pair of panel lower T-shaped member upwardly-extending vertical end parts 54 that extend upwardly from a pair of panel lower T-shaped member horizontal part ends 55 of the panel lower T-shaped member horizontal part 50 of the panel lower internally-disposed and inverted substantially T-shaped member 48 of the thin generally rectangular-parallelpiped-shaped panel 22 to a distance less than the length of the panel lower T-shaped member upwardly-extending vertical part 52 of the panel lower internally-disposed and inverted substantially T-shaped member 48 of the thin generally rectangular-parallelpiped-shaped panel 22.

One of the pair of panel lower T-shaped member upwardly-extending vertical end parts 54 of the panel lower internally-disposed and inverted substantially T-shaped member 48 of the thin generally rectangular-parallelpiped-shaped panel 22 is displaced below, and in alignment with, a corresponding one of the pair of panel upper T-shaped member downwardly-extending vertical end parts 46 of the panel upper internally-disposed and substantially T-shaped member 40 of the thin generally rectangular-parallelpiped-shaped panel 22 and defines therebetween a panel first side long throughslot 57 and forms therewith a panel first side 56.

The panel first side 56 of the thin generally rectangular-parallelpiped-shaped panel 22, the panel upper T-shaped member downwardly-extending vertical part 44 of the panel upper internally-disposed and substantially T-shaped member 40 of the thin generally rectangular-parallelpiped-shaped panel 22 and the part of the panel upper T-shaped member horizontal part 42 of the panel upper internally-disposed and substantially T-shaped member 40 of the thin generally rectangular-parallelpiped-shaped panel 22 therebetween, and the panel lower T-shaped member upwardly-extending vertical part 52 of the panel lower internally-disposed and inverted substantially T-shaped member 48 of the thin generally rectangular-parallelpiped-shaped panel 22 and the part of the panel lower T-shaped member horizontal part 50 of the panel lower internally-disposed and inverted substantially T-shaped member 48 of the thin generally rectangular-parallelpiped-shaped panel 22 between itself and the panel first side 56 of the thin generally rectangular-parallelpiped-shaped panel 22 together define a panel first side large, internally-disposed, and generally rectangular-parallelpiped-shaped chamber 58 that opens into the panel first side long throughslot 57 of the panel first side 56 of the thin generally rectangular-parallelepiped-shaped panel 22.

A pair of panel first side shoulders 60 is formed where the panel first side long throughslot 57 of the panel first side 56 of the thin generally rectangular-parallelpiped-shaped panel 22 opens into the panel first side large, internally-disposed, and generally rectangular-parallelpiped-shaped chamber 58 of the thin generally rectangular-parallelpiped-shaped panel 22.

The thin generally rectangular-parallelpiped-shaped panel 22 further has a panel second side internally-disposed and substantially T-shaped member 62 that is disposed opposite to the panel first side long throughslot 57 of the panel first side 56 of the thin generally rectangular-parallelpiped-shaped panel 22.

The panel second side internally-disposed and substantially T-shaped member 62 of the thin generally rectangular-parallelepiped-shaped panel 22 has a panel second side T-shaped member vertical part 64 that extends along the second side of the panel generally rectangular-parallelpiped-shaped first face 32 of the thin generally rectangular-parallelpiped-shaped panel 22 and along the second side of the panel generally rectangular-parallelpiped-shaped second face 36 of the thin generally rectangular-parallelpiped-shaped panel 22.

The panel second side internally-disposed and substantially T-shaped member 62 of the thin generally rectangular-parallelpiped-shaped panel 22 further has a panel second side T-shaped member inwardly-extending horizontal part 66 that extends inwardly from the midpoint of the panel second side T-shaped member vertical part 64 of the panel second side internally-disposed and substantially T-shaped member 62 of the thin generally rectangular-parallelpiped-shaped panel 22 and terminates prior to the panel first face centrally-disposed, laterally-oriented, and threaded through-bore 34 of the panel generally rectangular-parallelpiped-shaped first face 32 of the thin generally rectangular-parallelpiped-shaped panel 22 and the aligned panel second face centrally-disposed, laterally-oriented, and threaded through-bore 38 of the panel generally rectangular-parallelpiped-shaped second face 36 of the thin generally rectangular-parallelpiped-shaped panel 22.

The panel second side T-shaped member vertical part 64 of the panel second side internally-disposed and substantially T-shaped member 62 of the thin generally rectangular-parallelpiped-shaped panel 22 is spaced between the other one of the pair of panel upper T-shaped member downwardly-extending vertical end parts 46 of the panel upper internally-disposed and inverted substantially T-shaped member 40 of the thin generally rectangular-parallelpiped-shaped panel 22 and the corresponding other one of the pair of panel lower T-shaped member upwardly-extending vertical end parts 54 of the panel lower internally-disposed and inverted substantially T-shaped member 48 of the thin generally rectangular-parallelpiped-shaped panel 22 and defines therebetween a pair of panel second side short throughslots 68 and forms therewith a panel second side 70.

The panel second side 70 of the thin generally rectangular-parallelpiped-shaped panel 22 and the panel upper T-shaped member downwardly-extending vertical part 44 of the panel upper internally-disposed and substantially T-shaped member 40 of the thin generally rectangular-parallelpiped-shaped panel 22 and the part of the panel upper T-shaped member horizontal part 42 of the panel upper internally-disposed and substantially T-shaped member 40 of the thin generally rectangular-parallelpiped-shaped panel 22 therebetween, the panel second side 70 of the thin generally rectangular-parallelpiped-shaped panel 22 and the panel lower T-shaped member upwardly-extending vertical part 52 of the panel lower internally-disposed and inverted substantially T-shaped member 48 of the thin generally rectangular-parallelpiped-shaped panel 22 and the part of the panel lower T-shaped member horizontal part 50 of the panel lower internally-disposed and inverted substantially T-shaped member 48 of the thin generally rectangular-parallelpiped-shaped panel 22 therebetween, and the panel second side internally-disposed and substantially T-shaped member 62 of the thin generally rectangular-parallelpiped-shaped panel 22 together define a pair of panel second side small, internally-disposed, spaced-apart, and generally rectangular-parallelpiped-shaped chambers 72 that open into the pair of second side short throughslots 68 of the panel second side 70 of the thin generally rectangular-parallelpiped-shaped panel 22.

Two pair of panel second side shoulders 74 are formed where the pair of panel second side short throughslots 68 of the panel second side 70 of the thin generally rectangular-parallelepiped-shaped panel 22 open into the pair of panel second side small, internally-disposed, spaced-apart, and generally rectangular-parallelpiped-shaped chambers 72 of the thin generally rectangular-parallelpiped-shaped panel 22.

The panel first side large, internally-disposed, and generally rectangular-parallelpiped-shaped chamber 58 of the thin generally rectangular-parallelpiped-shaped panel 22 is larger than the pair of panel second side small, internally-disposed, spaced-apart, and generally rectangular-parallelpiped-shaped chambers 72 of the thin generally rectangular-parallelpiped-shaped panel 22.

The thin generally rectangular-parallelpiped-shaped panel 22 further has a panel first side large, extendable, retractable, and generally rectangular-parallelpiped-shaped extension member 76 with a panel first side extension member distal side 78 and a panel first side extension member proximal side 80 from which a pair of panel first side extension member proximal side outwardly-extending stop blocks 82 outwardly extend.

The panel first side large, extendable, retractable, and generally rectangular-parallelpiped-shaped extension member 76 of the thin generally rectangular-parallelpiped-shaped panel 22 is disposed in the panel first side large, internally-disposed, and generally rectangular-parallelpiped-shaped chamber 58 of the thin generally rectangular-parallelpiped-shaped panel 22 and is slidable through the panel first side long throughslot 57 of the panel first side 56 of the thin generally rectangular-parallelpiped-shaped panel 22.

The panel first side large, extendable, retractable, and generally rectangular-parallelpiped-shaped extension member 76 of the thin generally rectangular-parallelpiped-shaped panel 22 is slidably extendable from the panel first side large, internally-disposed, and generally rectangular-parallelpiped-shaped chamber 58 of the thin generally rectangular-parallelpiped-shaped panel 22, in the direction of a panel first side extension member extension arrow 84, until the pair of panel first side extension member proximal side outwardly-extending stop blocks 82 of the panel first side extension member proximal side 80 of the panel first side large, extendable, retractable, and generally rectangular-parallelpiped-shaped extension member 76 contact the pair of panel first side shoulders 60 of the panel first side 56 of the thin generally rectangular-parallelpiped-shaped panel 22.

The panel first side large, extendable, retractable, and generally rectangular-parallelpiped-shaped extension member 76 of the thin generally rectangular-parallelpiped-shaped panel 22 is slidably retractable into the panel first side large, internally-disposed, and generally rectangular-parallelpiped-shaped chamber 58 of the thin generally rectangular-parallelpiped-shaped panel 22, in the direction of a panel first side extension member retraction arrow 86, until the panel first side extension member proximal side 80 of the panel first side large, extendable, retractable, and generally rectangular-parallelpiped-shaped extension member 76 contacts the panel lower T-shaped member upwardly-extending vertical part 52 of the panel lower internally-disposed and inverted substantially T-shaped member 48 of the thin generally rectangular-parallelpiped-shaped panel 22 and the panel upper T-shaped member downwardly-extending vertical part 44 of the panel upper internally-disposed and substantially T-shaped member 40 of the thin generally rectangular-parallelpiped-shaped panel 22.

The thin generally rectangular-parallelpiped-shaped panel 22 further has a pair of panel second side small, spaced-apart, extendable, retractable, and generally rectangular-parallelpiped-shaped extension members 88.

Each of the pair of panel second side small, spaced-apart, extendable, retractable, and generally rectangular-parallelpiped-shaped extension members 88 of the panel second side 70 of the thin generally rectangular-parallelpiped-shaped panel 22 has a panel second side extension member distal side 90 and a panel second side extension member proximal side 92 from which a pair of panel second side extension member proximal side outwardly-extending stop blocks 94 outwardly extend.

Each of the pair of panel second side small, spaced-apart, extendable, retractable, and generally rectangular-parallelpiped-shaped extension members 88 of the panel second side 70 of the thin generally rectangular-parallelpiped-shaped panel 22 are disposed in a respective one of the pair of panel second side small, internally-disposed, spaced-apart, and generally rectangular-parallelpiped-shaped chambers 72 of the thin generally rectangular-parallelpiped-shaped panel 22 and is slidable through a respective one of the pair of panel second side short throughslots 68 of the panel second side 70 of the thin generally rectangular-parallelpiped-shaped panel 22.

Each of the pair of panel second side small, spaced-apart, extendable, retractable, and generally rectangular-parallelpiped-shaped extension members 88 of the panel second side 70 of the thin generally rectangular-parallelpiped-shaped panel 22 is slidably extendable from the respective one of the pair of panel second side small, internally-disposed, spaced-apart, and generally rectangular-parallelpiped-shaped chambers 72 of the thin generally rectangular-parallelpiped-shaped panel 22, in the direction of a panel second side extension member extension arrow 96, until the pair of panel second side extension member proximal side outwardly-extending stop blocks 94 of the panel second side extension member proximal side 92 of the respective one of the pair of panel second side small, spaced-apart, extendable, retractable, and generally rectangular-parallelpiped-shaped extension members 88 of the panel second side 70 of the thin generally rectangular-parallelpiped-shaped panel 22 contact a respective pair of the two pair of panel second side shoulders 74 of the panel second side 70 of the thin generally rectangular-parallelpiped-shaped panel 22.

Each of the pair of panel second side small, spaced-apart, extendable, retractable, and generally rectangular-parallelpiped-shaped extension members 88 of the panel second side 70 of the thin generally rectangular-parallelpiped-shaped panel 22 is slidably retractable into the respective one of the pair of panel second side small, internally-disposed, spaced-apart, and generally rectangular-parallelpiped-shaped chambers 72 of the thin generally rectangular-parallelpiped-shaped panel 22, in the direction of a panel second side extension member retraction arrow 98, until the panel second side extension member proximal side 92 of the respective one of the pair of panel second side small, spaced-apart, extendable, retractable, and generally rectangular-parallelpiped-shaped extension members 88 of the panel second side 70 of the thin generally rectangular-parallelpiped-shaped panel 22 contacts the respective one of the panel lower T-shaped member upwardly-extending vertical part 52 of the panel lower internally-disposed and inverted substantially T-shaped member 48 of the thin generally rectangular-parallelpiped-shaped panel 22 and the panel upper T-shaped member downwardly-extending vertical part 44 of the panel upper internally-disposed and substantially T-shaped member 40 of the thin generally rectangular-parallelpiped-shaped panel 22.

Figure 4:
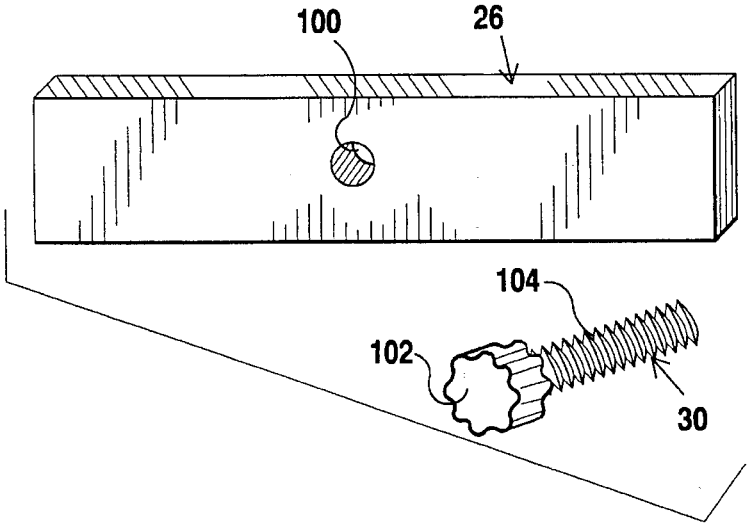
FIG. 4 is an enlarged diagrammatic perspective view of the cross member and bolt of the present invention.

The specific configuration of the elongated and generally rectangular-parallelpiped-shaped cross member 26 and the bolt 30, can best be seen in FIGS. 2 and 4, and as such, will be discussed with reference thereto.

The elongated and generally rectangular-parallelpiped-shaped cross member 26 has a cross member centrally-disposed, unthreaded, and laterally-oriented clearance throughbore 100 and a length substantially equal to the width of the thin generally rectangular-parallelpiped-shaped panel 22 when the panel first side large, extendable, retractable, and generally rectangular-parallelpiped-shaped extension member 76 of the thin generally rectangular-parallelpiped-shaped panel 22 and the pair of panel second side small, spaced-apart, extendable, retractable, and generally rectangular-parallelpiped-shaped extension members 88 of the panel second side 70 of the thin generally rectangular-parallelpiped-shaped panel 22 are fully extended.

The bolt 30 has a bolt substantially star-shaped knob head 102 and a bolt outwardly extending and threaded shaft 104 that extends outwardly from the bolt substantially star-shaped knob head 102 of the bolt 30 and passes through the cross member centrally-disposed, unthreaded, and laterally-oriented clearance throughbore 100 of the elongated and generally rectangular-parallelpiped-shaped cross member 26 and threadably engages the panel first face centrally-disposed, laterally-oriented, and threaded throughbore 34 of the panel generally rectangular-parallelpiped-shaped first face 32 of the thin generally rectangular-parallelpiped-shaped panel 22 and the panel second face centrally-disposed, laterally-oriented, and threaded throughbore 38 of the panel generally rectangular-parallelpiped-shaped shaped second face 36 of the thin generally rectangular-parallelpiped-shaped panel 22.

The bolt substantially star-shaped knob head 102 of the bolt 30 is of a shape and of a sufficient size to make it difficult for a child 20 to grab it with its small hands and has a width sufficient to prevent it from passing through the cross member centrally-disposed, unthreaded, and laterally-oriented throughbore 100 of the elongated and generally rectangular-parallelpiped-shaped cross member 26.

The operation of the adjustable passageway gate 10 can best be seen in FIGS. 1 and 2, and as such, will be discussed with reference thereto.

The thin generally rectangular-parallelpiped-shaped panel 22 is positioned on one side of the opened door passageway 12.

The panel first side large, extendable, retractable, and generally rectangular-parallelpiped-shaped extension member 76 of the panel first side 56 of the thin generally rectangular-parallelpiped-shaped panel 22 and the pair of panel second side small, spaced-apart, extendable, retractable, and generally rectangular-parallelpiped-shaped extension members 88 of the panel second side 70 of the thin generally rectangular-parallelpiped-shaped panel 22 are extended a distance sufficient to contact the conventional wall first side 24 of the conventional wall 18.

The elongated and generally rectangular-parallelpiped-shaped cross member 26 is positioned on the other side of the opened door passageway 12 and contacts the conventional wall second side 28 of the conventional wall 18.

The bolt substantially star-shaped knob head 102 of the bolt 30 is turned and causes the bolt outwardly extending and threaded shaft 104 of the bolt 30 to thread into the panel first face centrally-disposed, laterally-oriented, and threaded throughbore 34 of the panel generally rectangular-parallelpiped-shaped first face 32 of the thin generally rectangular-parallelpiped-shaped panel 22 and thread into the panel second face centrally-disposed, laterally-oriented, and threaded throughbore 38 of the panel generally rectangular-parallelpiped-shaped second face 36 of the thin generally rectangular-parallelpiped-shaped panel 22.

The elongated and generally rectangular-parallelpiped-shaped cross member 26 and the thin generally rectangular-parallelpiped-shaped panel 22 are caused to move towards each other until the thin generally rectangular-parallelpiped-shaped panel 22 securely abuts against the conventional wall first side 24 of the conventional wall 18 and the elongated and generally rectangular-parallelpiped-shaped cross member 26 securely abuts against the conventional wall second side 28 of the conventional wall 18, so that the conventional wall 18 is compressingly sandwiched therebetween and the opened door passageway 12 is blocked from undesirable passage therethrough.

The adjustable passageway gate 10 can be reversed and used on both right and left hinged doors while the presence of the spacing between the pair of panel second side small, spaced-apart, extendable, retractable, and generally rectangular-parallelpiped-shaped extension members 88 of the panel second side 70 of the thin generally rectangular-parallelpiped-shaped panel 22 allows the adjustable passageway gate 10 to straddle, and not interfere with, the lower door hinge.

It will be understood that each of the elements described above, or two or more together, may also find a useful application in other types of constructions differing from the types described above.

While the invention has been illustrated and described as embodied in an adjustable passageway gate, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An adjustable passageway gate, comprising:

a) a thin generally rectangular-parallelpiped-shaped panel having a first side, a second side disposed opposite to said first side of said thin generally rectangular-parallelpiped-shaped panel, and a centrally-disposed and laterally-oriented threaded throughbore; said thin generally rectangular-parallelepiped-shaped panel being positionable in a passageway defined by a wall that has a first side and a second side disposed opposite to the first side of the wall;

b) a large, extendable, retractable, and generally rectangular-parallelpiped-shaped extension member extendable from and retractable into said first side of said thin generally rectangular-parallelpiped-shaped panel and being extended to contact the first side of the wall when the passageway of the wall is wider than said thin generally rectangular-parallelpiped-shaped panel;

c) a pair of small, spaced-apart, extendable, retractable, and generally rectangular-parallelpiped-shaped extension members extendable from and retractable into said second side of said thin generally rectangular-parallelepiped-shaped panel and being extended to contact the first side of the wall when the passageway of the wall is wider than said thin generally rectangular-parallelpiped-shaped panel; said pair of small, spaced-apart, extendable, retractable, and generally rectangular-parallelpiped-shaped extension members being spaced apart, so that said adjustable passageway gate can straddle a lower door hinge of a door when the passageway is created by the door being opened and can be used on doors that swing outwardly and inwardly to the right and to the left;

d) an elongated and generally rectangular-parallelpiped-shaped cross member displaced a distance from said thin generally rectangular-parallelpiped-shaped panel and having a centrally-disposed and laterally-oriented throughbore and contacting the second side of the wall; and e) a bolt passing through said centrally-disposed and laterally-oriented throughbore of said elongated and generally rectangular-parallelpiped-shaped cross member and threadably engaging said centrally-disposed and laterally-oriented threaded throughbore of said thin generally rectangular-parallelpiped-shaped panel, so that the wall is sandwiched between said thin generally rectangular-parallelpiped-shaped panel and said elongated and generally rectangular-parallelepiped-shaped cross member and the passageway of the wall is blocked.

2. The gate as defined in claim 1, wherein said thin generally rectangular-parallelpiped-shaped panel further has a generally rectangular-parallelpiped-shaped front face with a top, a bottom, a first side, a second side disposed opposite to said first side of said thin generally rectangular-parallelpiped-shaped panel, and a centrally-disposed, laterally-oriented, and threaded throughbore; said thin generally rectangular-parallelpiped-shaped panel further has a generally rectangular-parallelpiped-shaped second face that is displaced a distance from and is parallel to said generally rectangular-parallelpiped-shaped first face of said thin generally rectangular-parallelepiped-shaped panel and has a top, a bottom, a first side, and a second side disposed opposite to said first side of said thin generally rectangular-parallelpiped-shaped panel; said generally rectangular-parallelpiped-shaped second face of said thin generally rectangular-parallelpiped-shaped panel has a centrally-disposed, laterally-oriented, and threaded throughbore that is in lateral alignment with said centrally-disposed, laterally-oriented, and threaded throughbore of said generally rectangular-parallelpiped-shaped first face of said thin generally rectangular-parallelpiped-shaped panel.

3. The gate as defined in claim 2, wherein said thin generally rectangular-parallelpiped-shaped panel further has an upper internally-disposed and substantially T-shaped member that connects said top of said generally rectangular-parallelpiped-shaped first face of said thin generally rectangular-parallelpiped-shaped panel to said top of said generally rectangular-parallelpiped-shaped second face of said thin generally rectangular-parallelpiped-shaped panel.

4. The gate as defined in claim 3, wherein said upper internally-disposed and substantially T-shaped member of said thin generally rectangular-parallelpiped-shaped panel has a horizontal part that has a midpoint and a pair of ends and extends along said top of said generally rectangular-parallelepiped-shaped first face of said thin generally rectangular-parallelpiped-shaped panel and along said top of said generally rectangular-parallelpiped-shaped second face of said thin generally rectangular-parallelpiped-shaped panel and forms therewith a top of said thin generally rectangular-parallelpiped-shaped panel.

5. The gate as defined in claim 4, wherein said upper internally-disposed and substantially T-shaped member of said thin generally rectangular-parallelpiped-shaped panel further has a downwardly-extending vertical part that has a length and extends downwardly from said midpoint of said horizontal part of said upper internally-disposed and substantially T-shaped member of said thin generally rectangular-parallelpiped-shaped panel and terminates prior to said centrally-disposed, laterally-oriented, and threaded throughbore of said thin generally rectangular-parallelpiped-shaped panel.

6. The gate as defined in claim 5, wherein said upper internally-disposed and substantially T-shaped member of said thin generally rectangular-parallelpiped-shaped panel further has a pair of downwardly-extending vertical end parts that extend downwardly from said pair of ends of said horizontal part of said upper internally-disposed and substantially T-shaped member of said thin generally rectangular-parallelpiped-shaped panel a distance less than said length of said vertical part of said upper internally-disposed and substantially T-shaped member of said thin generally rectangular-parallelpiped-shaped panel.

7. The gate as defined in claim 6, wherein said thin generally rectangular-parallelpiped-shaped panel further has a lower internally-disposed and inverted substantially T-shaped member that connects said bottom of said generally rectangular-parallelpiped-shaped first face of said thin generally rectangular-parallelpiped-shaped panel to said bottom of said generally rectangular-parallelpiped-shaped second face of said thin generally rectangular-parallelpiped-shaped panel.

8. The gate as defined in claim 7, wherein said lower internally-disposed and inverted substantially T-shaped member of said thin generally rectangular-parallelpiped-shaped panel has a horizontal part that has a midpoint and a pair of ends and extends along said bottom of said generally rectangular-parallelpiped-shaped first face of said thin generally rectangular-parallelepiped-shaped panel and said bottom of said generally rectangular-parallelpiped-shaped second face of said thin generally rectangular-parallelpiped-shaped panel and forms therewith a bottom of said thin generally rectangular-parallelpiped-shaped panel.

9. The gate as defined in claim 8, wherein said lower internally-disposed and inverted substantially T-shaped member of said thin generally rectangular-parallelpiped-shaped panel further has an upwardly-extending vertical part that has a length and extends upwardly from said midpoint of said horizontal part of said lower internally-disposed and inverted substantially T-shaped member of said thin generally rectangular-parallelpiped-shaped panel and terminates prior to said centrally-disposed, laterally-oriented, and threaded throughbore of said thin generally rectangular-parallelpiped-shaped panel; said upwardly-extending vertical part of said lower internally-disposed and inverted substantially T-shaped member of said thin generally rectangular-parallelpiped-shaped panel is disposed below and in alignment with said downwardly-extending vertical part of said upper internally-disposed and substantially T-shaped member of said thin generally rectangular-parallelpiped-shaped panel.

10. The gate as defined in claim 9, wherein said lower internally-disposed and inverted substantially T-shaped member of said thin generally rectangular-parallelpiped-shaped panel further has a pair of upwardly-extending vertical end parts that extend upwardly from said pair of ends of said horizontal part of said lower internally-disposed and inverted substantially T-shaped member of said thin generally rectangular-parallelpiped-shaped panel a distance less than said length of said upwardly-extending vertical part of said lower internally-disposed and inverted substantially T-shaped member of said thin generally rectangular-parallelpiped-shaped panel.

11. The gate as defined in claim 10, wherein one of said pair of upwardly-extending vertical end parts of said pair of ends of said lower internally-disposed and inverted substantially T-shaped member of said thin generally rectangular-parallelpiped-shaped panel is displaced below and in alignment with a corresponding one of said pair of downwardly-extending vertical end parts of said pair of ends of said upper internally-disposed and substantially T-shaped member of said thin generally rectangular-parallelpiped-shaped panel and forms therewith a first side of said thin generally rectangular-parallelpiped-shaped panel and defines therebetween a long throughslot of said first side of said thin generally rectangular-parallelpiped-shaped panel.

12. The gate as defined in claim 11, wherein said first side of said thin generally rectangular-parallelpiped-shaped panel, said downwardly-extending vertical part of said upper internally-disposed and substantially T-shaped member of said thin generally rectangular-parallelpiped-shaped panel, a part of said horizontal part of said upper internally-disposed and substantially T-shaped member of said thin generally rectangular-parallelpiped-shaped panel between said first side of said thin generally rectangular-parallelpiped-shaped panel and said downwardly-extending vertical part of said upper internally-disposed and substantially T-shaped member of said thin generally rectangular-parallelpiped-shaped panel, said upwardly extending vertical part of said lower internally-disposed and inverted substantially T-shaped member of said thin generally rectangular-parallelpiped-shaped panel, and a part of said horizontal part of said lower internally-disposed and inverted substantially T-shaped member of said thin generally rectangular-parallelpiped-shaped panel between said first side of said thin generally rectangular-parallelpiped-shaped panel and said upwardly-extending vertical part of said upper internally-disposed and inverted substantially T-shaped member of said thin generally rectangular-parallelpiped-shaped panel together define a large, internally-disposed, and generally rectangular-parallelpiped-shaped chamber that opens into said long throughslot of said first side of said thin generally rectangular-parallelpiped-shaped panel.

13. The gate as defined in claim 12, wherein said thin generally rectangular-parallelpiped-shaped panel further has a pair of shoulders formed where said long throughslot of said first side of said thin generally rectangular-parallelpiped-shaped panel opens into said large, internally-disposed, and generally rectangular-parallelepiped-shaped chamber of said thin generally rectangular-parallelpiped-shaped panel.

14. The gate as defined in claim 13, wherein said large, extendable, retractable, and generally rectangular-parallelpiped-shaped extension member has a distal side and a proximal side from which a pair of outwardly-extending stop blocks outwardly extend; said large, extendable, retractable, and generally rectangular-parallelpiped-shaped extension member of said thin generally rectangular-parallelepiped-shaped panel is movably disposed in said large, internally-disposed, and generally rectangular-parallelpiped-shaped chamber of said thin generally rectangular-parallelpiped-shaped panel and is slidable through said long throughslot of said first side of said thin generally rectangular-parallelpiped-shaped panel; said large, extendable, retractable, and generally rectangular-parallelpiped-shaped extension member of said thin generally rectangular-parallelpiped-shaped panel is slidably extendable from said large, internally-disposed, and generally rectangular-parallelpiped-shaped chamber of said thin generally rectangular-parallelpiped-shaped panel until said pair of outwardly-extending stop blocks of said proximal side of said large, extendable, retractable, and generally rectangular-parallelpiped-shaped extension member contact said pair of shoulders of said first side of said thin generally rectangular-parallelpiped-shaped panel; said large, extendable, retractable, and generally rectangular-parallelpiped-shaped extension member of said thin generally rectangular-parallelpiped-shaped panel is slidably retractable into said large, internally-disposed, and generally rectangular-parallelpiped-shaped chamber of said thin generally rectangular-parallelpiped-shaped panel until said proximal side of said large, extendable, retractable, and generally rectangular-parallelpiped-shaped extension member contacts said upwardly-extending vertical part of said lower internally-disposed and inverted substantially T-shaped member of said thin generally rectangular-parallelpiped-shaped panel and said downwardly-extending vertical part of said upper internally-disposed and substantially T-shaped member of said thin generally rectangular-parallelpiped-shaped panel.

15. The gate as defined in claim 13, wherein said thin generally rectangular-parallelpiped-shaped panel further has a second side internally-disposed and substantially T-shaped member that is disposed on said second side of said thin generally rectangular-parallelpiped-shaped panel opposite to said long throughslot of said first side of said thin generally rectangular-parallelpiped-shaped panel.

16. The gate as defined in claim 15, wherein said second side internally-disposed and substantially T-shaped member of said thin generally rectangular-parallelpiped-shaped panel has a vertical part that has a midpoint and extends along said second side of said first face of said thin generally rectangular-parallelpiped-shaped panel and along said second side of said generally rectangular-parallelpiped-shaped second face of said thin generally rectangular-parallelpiped-shaped panel.

17. The gate as defined in claim 16, wherein said second side internally-disposed and substantially T-shaped member of said thin generally rectangular-parallelepiped-shaped panel further has an inwardly-extending horizontal part that extends inwardly from said midpoint of said second side T-shaped member vertical part of said second side internally-disposed and substantially T-shaped member of said thin generally rectangular-parallelpiped-shaped panel and terminates prior to said centrally-disposed, laterally-oriented, and threaded throughbore of said thin generally rectangular-parallelpiped-shaped panel; said vertical part of said second side internally-disposed and substantially T-shaped member of said thin generally rectangular-parallelpiped-shaped panel is spaced between another one of said pair of downwardly-extending vertical end parts of said upper internally-disposed and inverted substantially T-shaped member of said thin generally rectangular-parallelpiped-shaped panel and a corresponding one of said pair of upwardly-extending vertical end parts of said lower internally-disposed and inverted substantially T-shaped member of said thin generally rectangular-parallelpiped-shaped panel and defines therebetween a pair of short throughslots and forms therewith a second side of said thin generally rectangular-parallelpiped-shaped panel; each of said pair of short throughslots of said second side of said thin generally rectangular-parallelpiped-shaped panel is shorter than said long throughslot of said first side of said thin generally rectangular-parallelpiped-shaped panel.

18. The gate as defined in claim 17, wherein said second side of said thin generally rectangular-parallelpiped-shaped panel, said downwardly-extending vertical part of said internally-disposed and substantially T-shaped member of said thin generally rectangular-parallelpiped-shaped panel, a part of said horizontal part of said upper internally-disposed and substantially T-shaped member of said thin generally rectangular-parallelpiped-shaped panel between said second side of said thin generally rectangular-parallelpiped-shaped panel and said downwardly-extending vertical part of said internally-disposed and substantially T-shaped member of said thin generally rectangular-parallelpiped-shaped panel, said upwardly-extending vertical part of said lower internally-disposed and inverted substantially T-shaped member of said thin generally rectangular-parallelpiped-shaped panel, a part of said horizontal part of said lower internally-disposed and inverted substantially T-shaped member of said thin generally rectangular-parallelepiped-shaped panel between said second side of said thin generally rectangular-parallelepiped-shaped panel and said upwardly-extending vertical part of said internally-disposed and inverted substantially T-shaped member of said thin generally rectangular-parallelpiped-shaped panel, and said second side internally-disposed and substantially T-shaped member together define a pair of small, internally-disposed, spaced-apart, and generally rectangular-parallelepiped-shaped chambers that open into said pair of short throughslots of said second side of said thin generally rectangular-parallelpiped-shaped panel; each of said pair of small, internally-disposed, spaced-apart, and generally rectangular-parallelpiped-shaped chambers of said thin generally rectangular-parallelpiped-shaped panel is smaller than said large, internally-disposed, and generally rectangular-parallelpiped-shaped chamber of said thin generally rectangular-parallelpiped-shaped panel.

19. The gate as defined in claim 18, wherein said thin generally rectangular-parallelpiped-shaped panel further has two pair of side shoulders formed where said pair of short throughslots of said second side of said thin generally rectangular-parallelpiped-shaped panel open into said pair of small, internally-disposed, spaced-apart, and generally rectangular-parallelpiped-shaped chambers of said thin generally rectangular-parallelpiped-shaped panel.

20. The gate as defined in claim 19, wherein each of said pair of small, spaced-apart, extendable, retractable, and generally rectangular-parallelpiped-shaped extension members has a distal side and a proximal side from which a pair of outwardly-extending stop blocks outwardly extend; each of said pair of small, spaced-apart, extendable, retractable, and generally rectangular-parallelpiped-shaped extension members of said thin generally rectangular-parallelpiped-shaped panel is movably disposed in a respective one of said pair of small, internally-disposed, spaced-apart, and generally rectangular-parallelpiped-shaped chambers of said thin generally rectangular-parallelpiped-shaped panel and is slidable through a respective one of said pair of short throughslots of said second side of said thin generally rectangular-parallelpiped-shaped panel; each of said pair of small, spaced-apart, extendable, retractable, and generally rectangular-parallelpiped-shaped extension members of said thin generally rectangular-parallelpiped-shaped panel is slidably extendable from said respective one of said pair of small, internally-disposed, spaced-apart, and generally rectangular-parallelpiped-shaped chambers of said thin generally rectangular-parallelpiped-shaped panel until said pair of outwardly-extending stop blocks of said proximal side of said respective one of said pair of small, spaced-apart, extendable, retractable, and generally rectangular-parallelpiped-shaped extension members of said of said thin generally rectangular-parallelpiped-shaped panel contact a respective pair of said two pair of shoulders of said second side of said thin generally rectangular-parallelpiped-shaped panel; each of said pair of small, spaced-apart, extendable, retractable, and generally rectangular-parallelpiped-shaped extension members of said thin generally rectangular-parallelpiped-shaped panel is slidably retractable into said respective one of said pair of small, internally-disposed, spaced-apart, and generally rectangular-parallelpiped-shaped chambers of said thin generally rectangular-parallelpiped-shaped panel until said proximal side of said respective one of said pair of small, spaced-apart, extendable, retractable, and generally rectangular-parallelpiped-shaped extension members of said thin generally rectangular-parallelpiped-shaped panel contacts a respective one of said upwardly-extending vertical part of said lower internally-disposed and inverted substantially T-shaped member of said thin generally rectangular-parallelpiped-shaped panel and said downwardly-extending vertical part of said upper internally-disposed and substantially T-shaped member of said thin generally rectangular-parallelpiped-shaped panel.

21. The gate as defined in claim 1, wherein said bolt has a knob head and an outwardly extending and threaded shaft that extends outwardly from said knob head of said bolt and passes through said centrally-disposed, unthreaded, and laterally-oriented throughbore of said elongated and generally rectangular-parallelpiped-shaped cross member and threadably engages said centrally-disposed, laterally-oriented, and threaded throughbore of said thin generally rectangular-parallelpiped-shaped panel.

22. The gate as defined in claim 21, wherein said knob head of said bolt has a shape and a size sufficient to make it difficult for a child to grab with the child's small hands of the child and has a diameter sufficient to prevent passage through said centrally-disposed, unthreaded, and laterally-oriented throughbore of said elongated and generally rectangular-parallelpiped-shaped cross member.

23. A method of using an adjustable passageway gate to prevent the undesirable passage through a passageway that is defined by a structure that has a first side and a second side that is disposed opposite to the first side of the structure, comprising the steps of:

a) positioning a thin generally rectangular-parallelepiped-shaped panel of said adjustable passageway gate across the passageway and contacting the first side of the structure;

b) positioning an elongated and generally rectangular-parallelepiped-shaped cross member of said adjustable passageway gate across the passageway and contacting the second side of the structure;

c) turning a bolt of said adjustable passageway gate by a knob head of said bolt;

d) causing an outwardly extending and threaded shaft of said bolt to pass through a centrally-disposed, laterally-oriented throughbore of said elongated and generally rectangular-parallelpiped-shaped cross member and be threaded into a centrally-disposed, laterally-oriented, and threaded throughbore of said thin generally rectangular-parallelpiped-shaped panel; and e) causing said elongated and generally rectangular-parallelepiped-shaped cross member and said thin generally rectangular-parallelpiped-shaped panel to move towards each other until said thin generally rectangular-parallelpiped-shaped panel securely abuts against the first side of the structure and said elongated and generally rectangular-parallelpiped-shaped cross member securely abuts against said second side of the structure, so that the structure is sandwiched therebetween and the passageway is blocked from undesirable passage therethrough.

24. The method as defined in claim 23, further comprising the step of extending a large, extendable, retractable, and generally rectangular-parallelpiped-shaped extension member of said adjustable passageway gate and a pair of small, spaced-apart, extendable, retractable, and generally rectangular-parallelpiped-shaped extension members of said adjustable passageway gate from said thin generally rectangular-parallelpiped-shaped panel a distance sufficient to contact the first side of the structure when said thin generally rectangular-parallelpiped-shaped panel is not wide enough to contact the first side of the structure itself with said pair of small, spaced-apart, extendable, retractable, and generally rectangular-parallelpiped-shaped extension members straddling a lower door hinge when the passageway is created by an open door.

* * * * *